US008360067B2

(12) United States Patent
Duffy

(10) Patent No.: US 8,360,067 B2
(45) **Date of Patent: *Jan. 29, 2013**

(54) EXPANDABLE FACE MASK WITH ENGAGEABLE STIFFENING ELEMENT

(75) Inventor: Dean R. Duffy, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 3 days.

This patent is subject to a terminal disclaimer.

(21) Appl. No.: 13/291,528

(22) Filed: Nov. 8, 2011

(65) Prior Publication Data

US 2012/0047627 A1 Mar. 1, 2012

Related U.S. Application Data

(62) Division of application No. 12/337,842, filed on Dec. 18, 2008, now Pat. No. 8,074,660.

(51) Int. Cl.
*A62B 18/02* (2006.01)

(52) U.S. Cl. ..... 128/863; 128/205.27; 128/206.12; 128/206.19; 128/206.21; 128/206.28

(58) Field of Classification Search ..... 128/863, 128/205.27–205.29, 206.12–206.17, 206.19–206.21, 128/206.24, 206.25, 206.28, 207.13; 2/9, 2/173, 206, 424
See application file for complete search history.

(56) References Cited

U.S. PATENT DOCUMENTS

| | | | |
|---|---|---|---|
| 1,946,334 | A | 2/1934 | Schwartz |
| RE24,549 | E | 10/1958 | Haliczer |
| 3,985,132 | A | 10/1976 | Boyce |
| 4,300,549 | A | 11/1981 | Parker |
| 4,635,628 | A | 1/1987 | Hubbard |
| 4,688,566 | A | 8/1987 | Boyce |
| 4,850,347 | A | 7/1989 | Skov |
| 4,920,960 | A | 5/1990 | Hubbard |
| 4,966,140 | A | 10/1990 | Herzberg |
| 5,540,673 | A | 7/1996 | Thomas |
| 5,553,608 | A | 9/1996 | Reese |
| 5,699,791 | A | 12/1997 | Sukiennik |
| 5,701,893 | A | 12/1997 | Kern |
| 5,706,804 | A | 1/1998 | Baumann |
| 5,803,077 | A | 9/1998 | Gazzara |
| 5,934,275 | A | 8/1999 | Gazzara |
| 6,123,077 | A | 9/2000 | Bostock |
| 6,394,090 | B1 | 5/2002 | Chen |
| 6,427,693 | B1 | 8/2002 | Blackstock |

(Continued)

FOREIGN PATENT DOCUMENTS

| | | | |
|---|---|---|---|
| GB | 559064 | A | 7/1942 |
| GB | 889933 | A | 10/1959 |

(Continued)

OTHER PUBLICATIONS

International Search Report PCT/US2009/065609, Jun. 28, 2009, 3 pages.

*Primary Examiner* — Patricia Bianco
*Assistant Examiner* — Keri J Nelson
(74) *Attorney, Agent, or Firm* — Kenneth B. Wood

(57) ABSTRACT

Face masks that are provided in a generally flat configuration and are capable of being expanded to a cup-shaped configuration. Such masks include at least one porous layer that includes at least one pleat and that is capable of being expanded by at least partially unfolding the at least one pleat. The mask further includes at least one stiffening element that comprises at least one engaging feature. Upon expanding the porous layer, the engaging feature engages with the porous layer so as to enhance the ability of the mask to maintain the expanded, cup-shaped configuration.

20 Claims, 6 Drawing Sheets

U.S. PATENT DOCUMENTS

| | | | |
|---|---|---|---|
| 7,036,507 | B2 | 5/2006 | Jensen |
| 2006/0130841 | A1 | 6/2006 | Spence |
| 2006/0201513 | A1 | 9/2006 | Chu |
| 2006/0266364 | A1 | 11/2006 | Turdjian |
| 2008/0011303 | A1 | 1/2008 | Angadjivand |
| 2008/0105261 | A1 | 5/2008 | Harold |
| 2009/0320848 | A1 | 12/2009 | Steindorf |

FOREIGN PATENT DOCUMENTS

| | | | |
|---|---|---|---|
| JP | 2007-061536 | A | 3/2007 |
| JP | 2007-260110 | A | 10/2007 |
| KR | 20-0433854 | Y1 | 12/2006 |
| WO | WO 96/28216 | A1 | 9/1996 |
| WO | WO 2007/058442 | | 5/2007 |
| WO | WO 2008/085546 | | 7/2008 |

EXPANDABLE FACE MASK WITH ENGAGEABLE STIFFENING ELEMENT

CROSS-REFERENCE TO RELATED APPLICATIONS

This application is a divisional of U.S. Ser. No. 12/337,842, filed Dec. 18, 2008, now issued as U.S. Pat. No. 8,074,660, the disclosure of which is incorporated by reference in its entirety herein.

BACKGROUND

Face masks have found use in a variety of applications in which they are worn over the nose and the mouth of a user, for example to protect the user's respiratory system from particles suspended in the air and/or from unpleasant or noxious gases, to minimize the amount of material expelled from the user's respiratory system into the surrounding atmosphere, or both. Generally, such face masks have been provided in two basic designs—a molded cup-shaped form or a flat-folded form.

SUMMARY

Herein is disclosed, in various aspects and embodiments, a face mask ("mask") that is provided in a generally flat-folded configuration and is expandable to form a cup-shaped air chamber suitable to fit over the nose and mouth of a wearer. The mask comprises at least one porous layer that comprises at least one pleat and that is capable of being expanded from a smaller area to a larger area by at least partially unfolding the at least one pleat. The porous layer comprises a first major surface that is oriented toward the wearer when the mask is expanded to form a cup-shaped configuration, and a second major surface that is oriented away from the wearer when the mask is so expanded. The mask further comprises at least one stiffening element that is adjacent at least a portion of the first major surface of the porous layer, so as to be on the concave side of the mask when the mask is expanded to form a cup-shaped configuration. The stiffening element comprises at least one engaging feature that permits sliding movement, in a first direction, of a portion of the porous layer that is adjacent the engaging feature, while preventing sliding movement of the adjacent portion of the porous layer in a second direction opposite the first direction.

In one embodiment, at least one first engaging feature is positioned at a first location on the stiffening element and permits sliding movement of an adjacent portion of the porous layer, in a first direction, while preventing the adjacent portion from slidably moving in a second direction opposite the first direction. Additionally, at least one second engaging feature is positioned at a second location on the stiffening element and permits sliding movement of an adjacent portion of the porous layer in a direction that is different from the direction permitted by the first engaging feature, while preventing the adjacent portion from slidably moving in a direction that is different from the direction prevented by the first engaging features.

In a further embodiment, the stiffening element comprises a sheetlike material comprising at least an interior area bounded at least in part by a perimeter, wherein engaging features are provided at least at two locations on the perimeter of the stiffening element, with each engaging feature permitting sliding movement of an adjacent portion of a porous layer in a direction generally outward away from the interior area of the stiffening element, while preventing sliding movement of the adjacent portion of the porous layer generally inward toward the interior area of the stiffening element.

The ability of the engaging feature(s) of the stiffening element to permit sliding movement of an adjacent porous layer past the engaging feature in a first direction, and to prevent sliding movement of the adjacent porous layer past the engaging feature in a second direction that is opposite the first direction, may permit the desired expanding of the mask while also providing the expanded mask with an enhanced ability to resist deforming or collapsing.

Thus in one aspect, herein is disclosed a flat-folded, pleated face mask that is expandable into a cup shape for fitting over the mouth and nose of a person, comprising:

at least one porous layer that comprises first and second major surfaces and that comprises at least one pleat and that is capable of being expanded by at least partially unfolding the at least one pleat; and, at least one stiffening element adjacent at least a portion of the first major surface of the porous layer, the stiffening element comprising a sheet-like material comprising an interior area bounded by a perimeter, and wherein engaging features are provided at least at two locations on the perimeter of the stiffening element, wherein each engaging feature is arranged to allow sliding movement of an adjacent portion of the porous layer in a direction generally outward from the interior area of the stiffening element and to prevent sliding movement of the adjacent portion of the porous layer in a direction generally inward toward the interior area of the stiffening element.

Thus in another aspect, herein is disclosed a flat-folded, pleated face mask that is expandable into a cup shape for fitting over the mouth and nose of a person, comprising:

at least one porous layer that comprises at least one pleat and that is capable of being expanded by at least partially unfolding the at least one pleat; and, at least one stiffening element adjacent at least a portion of the porous layer, the stiffening element comprising at least one engaging feature in a first location on the stiffening element, arranged to allow a portion of the porous layer that is adjacent the engaging feature to slidably move past the engaging feature in a first direction and to prevent the adjacent portion of the porous layer from slidably moving past the engaging feature in a second direction opposite the first direction.

Thus in still another aspect, herein is disclosed a flat-folded, pleated face mask that is expandable into a cup shape for fitting over the mouth and nose of a person, comprising:

at least one porous layer that comprises at least one pleat and that is capable of being expanded by at least partially unfolding the at least one pleat; and, at least one stiffening element adjacent at least a portion of the porous layer, the stiffening element comprising: at least a first engaging feature in a first location on the stiffening element, arranged to allow a portion of the porous layer that is adjacent to the first engaging feature to slidably move past the first engaging feature in a first direction and to prevent the adjacent portion of the porous layer from slidably moving past the first engaging feature in a second direction opposite the first direction; and, at least a second engaging feature in a second location on the stiffening element, arranged to allow a portion of the porous layer that is adjacent to the second engaging feature to slidably move past the second engaging feature in a first direction and to prevent the adjacent portion of the porous layer from slidably moving past the second engaging feature in a second direction opposite the first direction; wherein the direction in which the first engaging feature prevents slidable movement of the portion of the porous layer adjacent to the first engaging feature, is different from the direction in which the second engaging feature prevents slidable movement of the portion of the porous layer adjacent to the second engaging feature.

These and other aspects of the invention will be apparent from the detailed description below. In no event, however, should the above summaries be construed as limitations on the claimed subject matter, which subject matter is defined solely by the attached claims, as may be amended during prosecution.

Like reference symbols in the various figures indicate like elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Although terms such as "top", bottom", "upper", lower", "under", "over", "front", "back", "outward", "inward", "up" and "down", and "first" and "second" may be used in this disclosure, it should be understood that those terms are used in their relative sense only unless otherwise noted.

DETAILED DESCRIPTION

Figure 1:
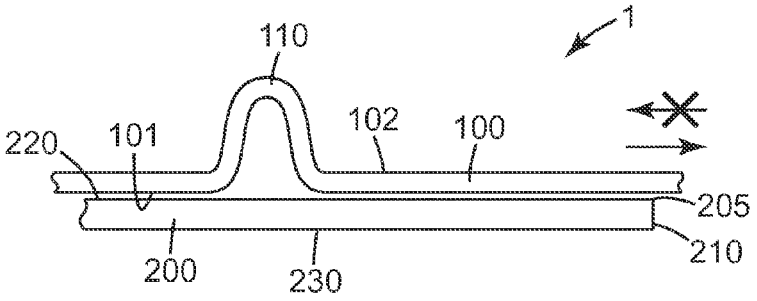
FIG. 1 is a schematic cross sectional view of a portion of an exemplary pleated mask in an unexpanded configuration.

Shown in FIG. 1 is a generic representation of a portion of an expandable face mask 1 (hereafter, "mask"). Mask 1 comprises at least porous layer 100, which comprises first major surface 102, which, upon mask 1 being worn by a user, faces generally outward and may comprise at least a portion of the outer, convex surface of mask 1, and, second major surface 101, which, upon mask 1 being worn by a user, faces generally inward and may comprise at least a portion of the inner, concave surface of mask 1. Porous layer 100 is sheet-like (that is, with a thickness substantially less than its length and breadth), and comprises at least one pleat (fold) 110.

Mask 1 also comprises at least one stiffening element 200, at least a portion of which is adjacent to at least a portion of surface 101 of porous layer 100 (such that stiffening element 200 is positioned on the concave side of mask 1 upon expansion of mask 1 into a cup-shaped configuration). Stiffening element 200 may comprise first major surface 230, which faces away from porous layer 100, and second major surface 220, which faces toward, and may or may not be in contact with, porous layer 100. Stiffening element 200 may be sheet-like (that is, with a thickness substantially less than its length and breadth). Stiffening element 200 may comprise edge 210, which may be continuous or discontinuous, as discussed later herein.

Stiffening element 200 comprises at least one engaging feature 205. At least a portion of porous layer 100 is slidably movable, with respect to an adjacent portion of stiffening element 200, in the direction indicated by the arrow in FIG. 1, while being prevented by engaging feature(s) 205 from slidably moving in the opposite direction indicated by the (X)-obscured arrow in FIG. 1. In this context, such preventing of sliding movement of a portion of porous layer 100 means that the portion of porous layer 100 cannot slidably move in this direction relative to stiffening element 200 at all, or cannot do so without unacceptable effects (e.g., damage, tearing, crumpling, etc.) on porous layer 100 and/or stiffening element 200. Thus, an engaging feature 205 as disclosed herein is designed so as to permit sliding movement of adjacent portion of porous layer 100 past engaging feature 205 in a first direction (during which process surface 101 of porous layer 100 may be in constant, intermittent, and/or occasional contact with the adjacent portion of stiffening element 200 and/or engaging feature 205, without being prevented from moving thereby), but to prevent sliding movement of adjacent porous layer 100 (e.g., by being caught by, snagged on, adhered to, entangled with, etc., at least some of the fibers of porous layer 100) past engaging feature 205 in a second direction that is opposite the first direction. In FIG. 1, engaging features 205 are provided by edge 210 of stiffening element 200; however, as discussed later herein in detail, many different types and configurations of engaging feature(s) 205 are possible.

In the exemplary illustration of FIG. 1, pleat 110 is shown as located in a portion of porous layer 100 that is adjacent to stiffening element 200; however, pleat 110 may be located so that it is not adjacent to stiffening element 200. In such a case the at least partial unfolding of pleat 110 may not occur adjacent, or near, stiffening element 200; however, the above-described slidable moving of some portion of porous layer 100 past engaging feature 205, will still occur.

Figure 2:
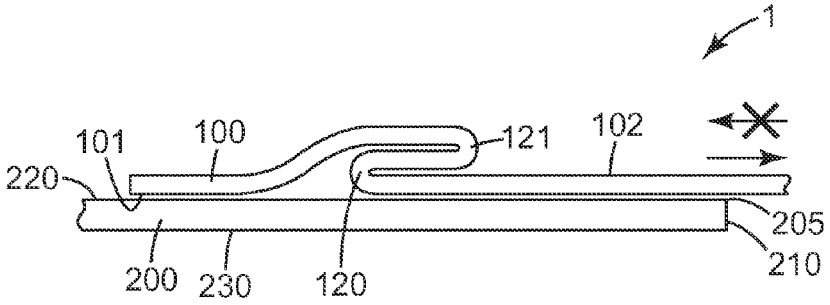
FIG. 2 is a schematic cross sectional view of a portion of an exemplary pleated mask in an unexpanded configuration.

The at least one pleat 110 of porous layer 100 of FIG. 1 may take the form of at least two generally parallel, oppositely-oriented pleats 120 and 121 as shown in FIG. 2, with 120 designating an inner pleat and 121 designating an outer pleat. In this configuration, at least a portion of porous layer 100 is capable of being slidably moved with respect to an adjacent portion of stiffening element 200, in the direction indicated by the arrow in FIG. 2, while being prevented by engaging feature(s) 205 from slidably moving in the opposite direction indicated by the obscured arrow in FIG. 2, in similar manner as described with reference to FIG. 1.

Figure 3:
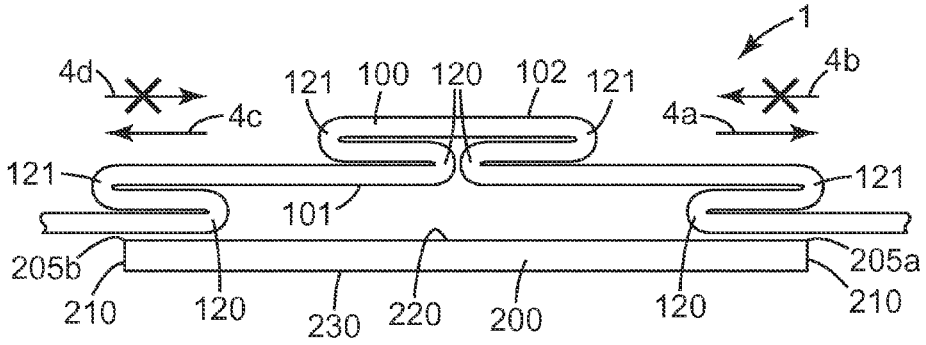
FIG. 3 is a schematic cross sectional view of a portion of an exemplary pleated mask in an unexpanded configuration.

FIG. 3 shows an exemplary flat folded, unexpanded mask, that comprises a multiplicity of pleats 120 and 121 in porous layer 100. Such multiple pleats may increase the degree to which porous layer 100 can be expanded by the at least partial unfolding of some or all of the pleats. In the exemplary illustration of FIG. 3, the size of stiffening element 200 relative to that of porous layer 100, the position of edges 210 of stiffening element 200 with respect to the various pleats of porous layer 100, the number, position, spacing, and orientation of the pleats, and so on, are depicted for ease of illustration only, with many configurations being possible. In an embodiment of the type shown in FIG. 3, various portions of porous layer 100 may be slidably movable relative to adjacent portions of stiffening element 200 in the directions indicated by the arrows in FIG. 3, while being prevented from moving in other directions indicated by the obscured arrows in FIG. 3. In a particular embodiment, differently-oriented (e.g., oppositely-oriented) engaging features 205*a* and 205*b* are provided in different portions of stiffening element 200, such that engaging features 205*a* prevent motion of an adjacent portion of porous layer 100 in a different direction (e.g., a generally opposite direction) than the motion prevented by engaging features 205*b*. In the specific embodiment shown in FIG. 3, engaging features 205*a* are positioned at or near one end of stiffening element 200 and permit sliding movement of an adjacent portion of porous layer 100 in the direction marked by arrow 4*a*, while preventing the adjacent portion from slidably moving in the direction marked by obscured arrow 4*b*; and, engaging features 205*b* are positioned at or near an opposite end of stiffening element 200 and permit sliding movement of an adjacent portion of porous layer 100 in the direction marked by arrow 4*c*, while preventing the adjacent portion from slidably moving in the direction marked by obscured arrow 4*d*.

Figure 4:
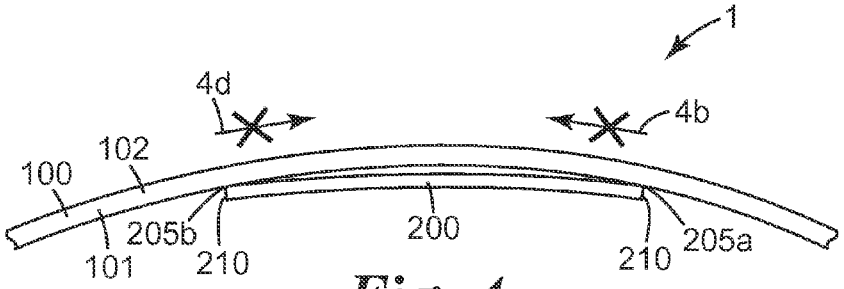
FIG. 4 is a schematic cross sectional view of a portion of an exemplary pleated mask in an expanded configuration.

FIG. 4 depicts in generic representation the result of expanding porous layer 100 (for example, the multi-pleated porous layer 100 of FIG. 3) relative to stiffening element 200. Pleats 120 and 121 now having been at least partially unfolded (and not shown on FIG. 4), porous layer 100 has been expanded to form a concave, generally cup-shaped configuration. It should be noted that FIG. 4 is depicted purely for purposes of generically illustrating the concepts disclosed herein, and that in reality, porous layer 100 may not necessarily expand to a smooth arc as shown in FIG. 4 (e.g., partially unfolded pleats 120/121 may still be observable).

In the configuration shown in FIG. 4, the engaging features 205*a* and 205*b* of stiffening element 200 are engaged with different portions of porous layer 100 (e.g., of surface 101 of these portions of porous layer 100), so as to prevent the different portions of porous layer 100 from slidably moving in certain directions (e.g., those indicated by obscured arrows 4*b* and 4*d* in FIG. 4) relative to stiffening element 200, in similar manner as explained with reference to FIG. 3. The direction of slidable movement indicated by obscured arrow 4*d*, that is prevented by engaging feature 205*b*, may be generally opposite the direction of slidable movement (shown by obscured arrow 4*b*) that is prevented by engaging feature 205*a* (with the term generally opposite being used since the directions may or may not be "exactly" opposite, e.g., depending on how pronounced the curvature of porous layer 100 and/or stiffening element 200 may be).

The disclosures herein are now further illustrated with reference to the exemplary illustration of FIG. 5, which shows a plan view of an exemplary flat-folded mask 1 in an initial, flat-folded, unexpanded state (viewed from the "inner" side that becomes the concave side upon expansion of mask 1). Mask 1 comprises porous layer 100, with first and second major surfaces 101 and 102 as previously described. In this exemplary design, mask 1 comprises a generally rectangular shape with upper edge 310 (which in use would be positioned on the wearer's nose and upper cheeks), lower edge 320, and side edges 330 and 340. Such edges may be formed and/or reinforced by seaming, e.g. by such techniques as ultrasonic welding, stitching, and the like, to form seamed edges. One or more headbands, not shown in FIG. 5, may be attached to side edges 330 and 340 and/or top and bottom edges 310 and 320. Optional formable nose piece 311 (e.g., a strip of soft metal, which may be used to assist in conforming upper edge 310 of porous layer 100 to the wearer's nose and/or upper cheeks) may be present. A plurality of generally parallel inner pleats 120 and outer pleats 121 may be present (with outer pleats 121 not shown in FIG. 5), generally oriented along the long axis of the mask. In the exemplary embodiment of FIG. 5, pleats 120 and 121 terminate at seamed side edges 330 and 340, so that the unfolding of at least the portion of each pleat that is near to edge 330 or 340, may be somewhat restricted. Thus, upon expansion of porous layer 100, pleats 120 and 121 may unfold to a greater extent in the central portion of porous layer 100 than in the areas closest to seamed side edges 330 and/or 340. This arrangement may provide that upon expanding mask 1 from a flat-folded configuration by at least partially unfolding at least some of the pleats in porous layer 100, porous layer 100 expands into a three dimensional concave shape (e.g., by virtue of greater expansion occurring in the central portion of porous layer 100 than near edges 330 and 340).

As disclosed herein, "flat-folded" means that porous layer 100 comprises a plurality of pleats arranged such that at least certain portions of porous layer 100 are arranged in at least partially overlapping relation (e.g., as shown in FIG. 3), such that air passing through at least certain portions of mask 1 may pass through multiple separate thicknesses of porous layer 100. In a flat-folded configuration, the majority of porous layer 100 may be substantially parallel to the plane of flat-folded mask 1, with the thickness of mask 1 being substantially less than the length and breadth of mask 1, even through at some or all locations on mask 1 the thickness of mask 1 may be comprised of multiple thicknesses of porous layer 100.

As disclosed herein, "expanding" means to at least partially unfold at least some of the pleats of porous layer 100 so that porous layer 100 presents a larger area for passage of air, such that, over a majority of the area of mask 1, it is only necessary for air to pass through a single thickness of porous layer 100 to pass through mask 1.

Figure 5:
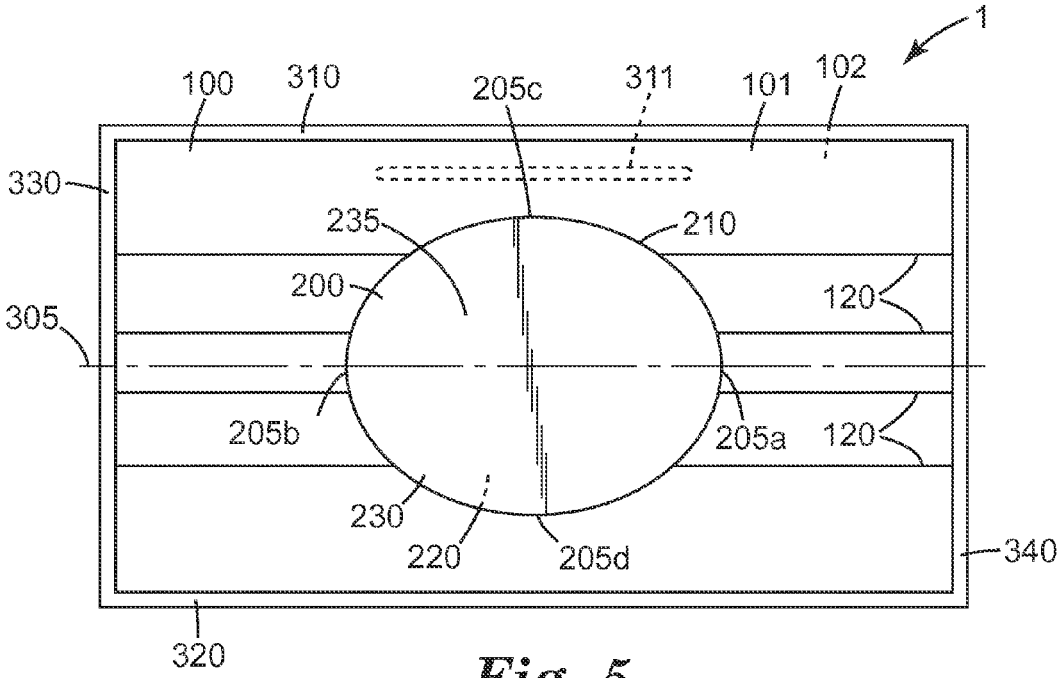
FIG. 5 is a plan view of an exemplary pleated mask in an unexpanded configuration.

In the embodiment exemplified in FIG. 5, stiffening element 200 is provided as a sheet-like structure with first surface 230 and second surface 220 and that is no greater than, or is smaller than, unexpanded porous layer 100 in length, breadth and/or area. In various embodiments, stiffening element 200 may comprise a nominal area that is at least about 10%, 20%, or 30% of the area of unexpanded porous layer 100. In additional embodiments, stiffening element 200 may comprise a nominal area that is at most about 100%, 90%, or 80%, of the area of unexpanded porous layer 100. In this context, the nominal area of stiffening element 200 denotes that area bounded by the perimeter of stiffening element 200, rather than the actual area physically occupied by the material comprising stiffening element 200 (which, in the case of, e.g., netting, might be rather small).

Stiffening element 200 comprises an interior area 235 bounded by a perimeter with a perimeter edge 210. Interior area 235 and/or perimeter edge 210 may be continuous or discontinuous as described later herein. With mask 1 in a flat-folded configuration, mask 1 and porous layer 100 thereof comprise a generally flat configuration as described above, with stiffening element 200 adjacent porous layer 100 and oriented generally parallel to the plane of mask 1. At least a portion of stiffening element 200 may be in contact with at least a portion of surface 101 of porous layer 100.

In one embodiment, a plurality of engaging features 205 is provided at least at or near (e.g., within a few mm of) perimeter edge 210 of stiffening element 200. In the specific embodiment shown in FIG. 5, the plurality of engaging features 205 is provided by perimeter edge 210 or a portion, feature, or component thereof (e.g., by a corner of perimeter edge 210 that is proximate surface 101 of porous layer 100). As discussed later herein in detail, engaging feature(s) 205 can be provided in many other ways.

As mentioned, various engaging features 205 can be differently (e.g., oppositely) oriented. In the exemplary embodiment shown in FIG. 5, engaging features 205*a* are generally oppositely oriented from engaging features 205*b*, and engaging features 205*c* are generally oppositely oriented from engaging features 205*d*.

Engaging features 205 can be present at least at two locations generally on the perimeter of stiffening element 200. In further embodiments, engaging features can be present at least on a portion of, a majority of, or the entirety of, the perimeter of stiffening element 200. The design shown in FIG. 5 is an example of an embodiment in which a plurality of engaging features 205 are present generally on the entire perimeter of stiffening element 200, with engaging features 205 permitting sliding movement of adjacent portions of porous layer 100 in directions generally outward with reference to interior area 235 of stiffening element 200, while preventing sliding movement of such adjacent portions generally inward toward interior area 235 of stiffening element 200.

Figure 6:
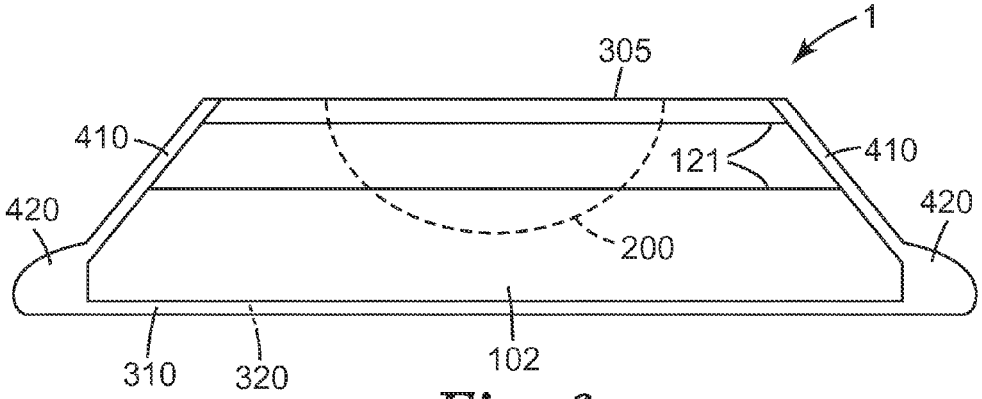
FIG. 6 is a plan view of an exemplary pleated mask in an unexpanded configuration.

FIG. 6 illustrates in plan view another exemplary flat-folded configuration in which mask 1 may be provided. The mask of FIG. 6 may be obtained, in one exemplary method, by providing a mask similar to that of FIG. 5 and folding it along fold line 305 such that upper edge 310 is brought near lower edge 320. (In the configuration shown in FIG. 6, fold line 305 is a bisecting fold line, such that upper edge 310 is positioned in alignment with lower edge 320, but other, e.g., offset, configurations are possible). In such a case, depending on the location and size of stiffening element 200, stiffening element 200 may or may not be folded along with porous layer 100 (in FIG. 6, stiffening element 200 is shown, in phantom, as folded). With porous layer 100 (and possibly, stiffening element 200) so folded, the top and bottom layers of folded mask 1 can be bonded together (e.g., by ultrasonic bonding, stitching, etc.) to form bonded seams. Excess material outside of the bonded seams can be removed (e.g., by die cutting) to form bonded seamed edges 410 that comprise the side edges of mask 1, as shown in FIG. 6. The cutting can be performed so as to provide tabs 420, to which one or more headbands (not shown in FIG. 6) can be fastened. This providing of bonded seamed side edges 410 may further limit (e.g., in comparison to a mask of the general type of FIG. 5) the unfolding of the portion of pleats 120/121 that are near bonded seamed side edges 410, thus possibly enhancing the degree to which mask 1 can form a cup shape that conforms advantageously to the wearer's face. If desired, flanges (not shown in FIG. 6) can be provided that project generally outward from bonded seamed side edges 410, such that when mask 1 is donned, the flanges project, e.g. both laterally and frontally, from mask 1, which may further assist in providing structural integrity to the mask to keep it in an expanded, cup-shaped configuration. The use of such flanges is described in U.S. patent application Ser. No. 12/338,084, filed on the same day as this patent application, entitled FLAT FOLD RESPIRATOR HAVING FLANGES DISPOSED ON THE MASK BODY, herein incorporated by reference.

The disclosures herein are now further illustrated with reference to the exemplary illustration of FIG. 7, which shows a perspective view, from the concave side, of an exemplary mask 1 in an expanded state. In this embodiment, stiffening element 200 comprises a sheet-like material with a multiplicity of engaging features provided by perimeter edge 210 (e.g., located on the entirety of the perimeter of the sheet-like material). When a user desires to expand a flat-folded mask (e.g., of the type shown in FIG. 6) into the expanded configuration of FIG. 7, upper and lower edges 310 and 320 can be pulled apart from each other in a central portion of mask 1, which will expose at least a portion of the concave interior of mask 1. Then, the user can apply pressure to stiffening element 200 against porous layer 100, and/or continue pulling edges 310 and 320 apart, so as to at least partially expand porous layer 100 from its pleated configuration by at least partially unfolding at least some portion of some pleats 120 and/or 121. During the expansion process, at least a portion of porous layer 100 will slidably move past an adjacent portion of stiffening element 200; specifically, at least a portion of porous layer 100 will slidably move past at least one engaging element 205 of stiffening element 200. In the particular configuration shown in FIG. 7, such sliding movement of various portions of porous layer 100 relative to portions of stiffening element 200 occurs in various directions generally outward relative to interior area 235 of stiffening element 200. The expansion is continued until mask 1 is expanded to an appropriate extent and engaging features 205 of stiffening element 200 are engaged with porous layer 100. This engaging may occur naturally at the end of the expanding process/sliding movement (e.g., due to slight retraction of porous layer 100 as pleats 120/121 attempt to partially assume their original pleated configuration). Or, the engaging may occur and/or be enhanced when tension is applied to mask 1 when it is placed upon the face of a user. Or, the engaging may be performed and/or enhanced by manual manipulations by the user. For example, the wearer may apply slight pressure to stiffening element 200 (e.g., to the perimeter of stiffening element 200) to promote the engaging of engaging features 205 with porous layer 100. The engaging of engaging features 205 with porous layer 100, and the maintaining of this engaging, may be enhanced by the arcuate shape typically assumed by porous layer 100 upon expansion, since this arcuate configuration may tend to naturally bring porous layer 100 into engagement with engaging features 205. In general, the engaging of engaging features 205 with porous layer 100 may occur at any location on porous layer 100; however, such engaging may be facilitated or enhanced (e.g., may occur more easily) at or near pleats, seams, edges, etc., in porous layer 100. In a particular embodiment, porous layer 100 may comprise features on at least a portion of inner surface 101 that facilitate or enhance the engaging of engaging features 205 with porous layer 100. For example, porous layer 100 may comprise a netting (e.g., of the type described later herein with reference to FIG. 11) laminated to inner surface 101 of porous layer 100 (e.g., to surface 131 of inside cover layer 130), such that engaging features 205 can engage with the strands of the netting.

Figure 7:
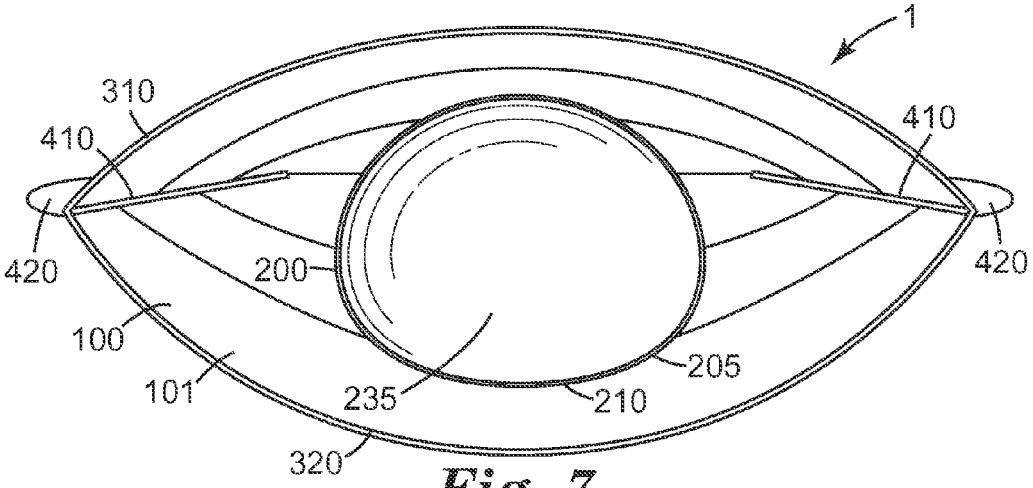
FIG. 7 is a perspective view of an exemplary pleated mask in an expanded configuration.

The result of this operation is the expansion of mask 1 from a flat-folded configuration into the concave, cup-shaped configuration of FIG. 7, with at least some of the pleats at least partially unfolded, and with stiffening element 200 engaged with porous layer 100. According to the disclosures herein, the engaging of stiffening element 200 with porous layer 100 may enhance the ability of mask 1 to maintain this cup-shaped configuration (for example, such that mask 1 may be more resistant to collapsing against the mouth of a user during inhalation, may be taken off and put on a number of times with the cup-shaped configuration being maintained, etc.).

Stiffening element 200 may assume a somewhat arcuate (i.e., bowed) shape (e.g., as shown in FIGS. 4 and 7), when mask 1 is in an expanded, cup-shaped configuration. The material of stiffening element 200 may be selected, and/or the geometric design of stiffening element 200 may be selected, so as to promote and/or control such bowing in a desired manner, so as to enhance the maintaining of mask 1 in an expanded, cup shaped configurations. Various embodiments of this type are discussed later herein with regard to FIGS. 15 and 16. Alternatively, stiffening element 200 may remain generally or substantially flat when mask 1 is in an expanded configuration.

The amount of bowing undergone by stiffening element 200 may impact how much of surface area 220 of stiffening element 200 is in contact with porous layer 100 when mask 1 is in an expanded configuration. In various embodiments, when mask 1 is in an expanded configuration, greater than about 50%, greater than about 70%, or greater than about 90%, of the area of surface 220 of stiffening element 200 is in contact with porous layer 100. In various alternative embodiments, when mask 1 is in an expanded configuration, less than about 30%, less than about 20%, or less than about 10%, of the area of surface 220 of stiffening element 200 is in contact with porous layer 100. In a further embodiment, only perimeter edge 210 of stiffening element 200 is in contact with porous layer 100, when mask 1 is so expanded.

In one embodiment (e.g., in the exemplary illustrations of FIGS. 5 and 7), stiffening element 200 is accessible from the concave side of mask 1. In such a case, if it is desired to refold mask 1 (e.g., to a generally flat configuration), it may be possible for the user to manually disengage engaging features 205 of stiffening element 200 from porous layer 100 and to then at least partially refold mask 1. For example, the user might manually pull porous layer 100 away from at least some portion of stiffening element 200 so as to disengage the two so that refolding can be performed without engaging features 205 coming in contact with porous layer 100.

The embodiments illustrated in FIGS. 5 and 6 show masks with pleats running generally parallel to the long axis of porous layer 100 (i.e., so as to be oriented transversely across the face of a wearer). In this design the direction of unfolding of the pleats is along the short axis of porous layer 100. In such a case, it may be useful to provide engaging features 205 that engage porous layer 100 at least with respect to preventing retrograde motion (i.e., motion of the adjacent portion of porous layer 100 in a direction generally opposite its initial motion during the expanding of porous layer 100) generally along this short axis. However, it may be useful as well to provide engaging features 205 that engage porous layer 100 with respect to preventing retrograde motion of porous layer 100 generally along the long axis of porous layer 100. (It is also possible to produce mask 1 with pleats oriented generally along the short axis of porous layer 100. In this case, it may be useful to at least provide engaging features 205 that prevent retrograde motion of porous layer 100 in a direction generally perpendicular to this, e.g. along the long axis of porous layer 100).

Thus in various embodiments, it may be advantageous to provide engaging features so as to prevent motion (e.g., retrograde motion) of various portions of porous layer 100 toward interior area 235 of stiffening element 200, along both major axes (e.g., long and short) of mask 1. In fact it may be advantageous to provide engaging features so as to prevent retrograde motion of porous layer 100 in all directions toward the interior area 235 of stiffening element 200. This can be achieved by a stiffening element 200 with engaging features 205 that are provided at multiple locations on the perimeter of stiffening element 200; e.g., of the general design shown in FIGS. 5 and 7.

Figure 8:
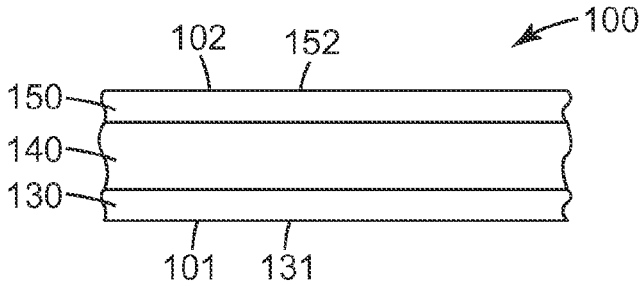
FIG. 8 is a schematic cross sectional view of a portion of an exemplary porous layer.
Figure 9:
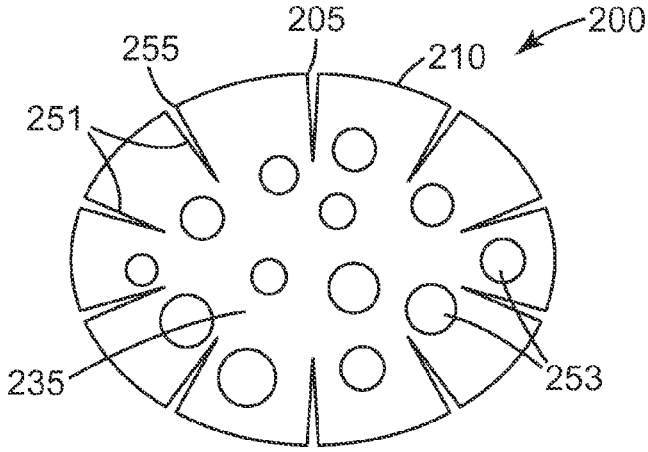
FIG. 9 is a plan view of an exemplary stiffening element.

The disclosures herein are now further illustrated with reference to the exemplary illustration of FIG. 8, which shows a cross-sectional view of an exemplary porous layer 100. Porous layer 100 can be used for performing filtration (i.e., to remove substances, whether solid, liquid, vaporous, gaseous, etc. from an airstream), and as such can comprise at least one filtration layer. In one embodiment, porous layer 100 may be comprised of two or more porous layers (e.g., sublayers) which may be present for various purposes. For example, with reference to FIG. 8, porous layer 100 may comprise at least one filtration layer 140 disposed between an outside cover layer 150 and an inside cover layer 130 (inside denoting a layer that will face inward within the concave interior of the expanded mask; outside referring to a layer that will face outward on the convex exterior of the expanded mask). In such case, during use of mask 1, air will pass sequentially through layers 150, 140 and 130 during inhalation, and sequentially through layers 130, 140 and 150 during exhalation (if desired, an exhalation valve (not shown in any Figure) may be used, which may allow at least a portion of the exhaled air to rapidly pass through the exhalation valve hence bypassing layers 130, 140 and 150). Any or all of filtration layer 140, inside cover layer 130, and outside cover layer 150, can be bonded together, for example at least at one or more edges of porous layer 100. Some or all of these layers can also be bonded (e.g., spot-bonded) in various other locations as desired.

Regardless of its specific construction, porous layer 100 may comprise a relatively low pressure drop (for example, less than about 195 to 295 Pascals at a face velocity of 13.8 centimeters per second, when measured such that the air passes only through a single thickness of porous layer 100). In specific embodiments, porous layer comprises a pressure drop of less than about 100 Pascals, or less than about 50 Pascals.

Filtration layer 140 may comprise any suitable layer or layers of material capable of performing filtration. Examples of suitable filter material may include microfiber webs, fibrillated film webs, woven or nonwoven webs (e.g., airlaid or carded staple fibers), solution-blown fiber webs, or combinations thereof. Fibers useful for forming such webs include, for example, polyolefins such as polypropylene, polyethylene, polybutylene, poly(4-methyl-1-pentene) and blends thereof, halogen substituted polyolefins such as those containing one or more chloroethylene units, or tetrafluoroethylene units, and which may also contain acrylonitrile units, polyesters, polycarbonates, polyurethanes, rosin-wool, glass, cellulose or combinations thereof. In a specific embodiment, filtration layer 140 comprises at least one layer of blown microfibers.

Filtration layer 140 may comprise such features as electrically charged fibers, staple fibers, bicomponent staple fibers, oil-resistant treatments (e.g., fluorinated surfaces), and the like. Filtration layer 140 (and/or porous layer 100 as a whole) may be primarily intended for the filtration of particulates; or, (for example by the inclusion of specific reagents, sorbent materials, etc.) may be also or instead intended for the removal of gaseous and/or vaporous substances and the like.

Outside cover layer 150, if present, may serve to protect filtration layer 140. If porous layer 100 comprises outside cover layer 150, surface 152 of outside cover layer 150 may comprise surface 102 of porous layer 100. Outside cover layer 150 may for example be comprised of a relatively lightweight and highly porous nonwoven material such as a spunbonded polyolefin. Or, outside cover layer 150 may be comprised of a reinforcing netting (e.g., comprised at least in part of intersecting, interconnected strands or filaments) that is laminated to porous layer 100. Or, outside cover layer 150 may comprise a layer of lightweight and highly porous nonwoven material with a reinforcing netting laminated to the nonwoven material. Masks comprising such reinforcing netting are described in further detail in U.S. patent application Ser. No. 12/338,091, filed on the same day as this patent application, entitled EXPANDABLE FACE MASK WITH REINFORCING NETTING, herein incorporated by reference.

Inside cover layer 130, if present, may also serve to protect filtration layer 140 and/or to provide a comfortable surface in case of contact with the wearer. If porous layer 100 comprises inside cover layer 130, surface 131 of inside cover layer 130 may comprise surface 101 of porous layer 100 that is engaged by engaging features 205 of stiffening element 200. If so, inside cover layer 130 should be chosen so as to be engageable by engaging feature(s) 205. Within this limitation, inside cover layer 130 can be chosen from any suitable material (e.g., such as a relatively lightweight and highly porous nonwoven material such as a spunbonded polyolefin).

Porous layer 100 can comprise other layers as desired. For example (e.g. for use in surgical applications) porous layer 100 can comprise one or more layers that are chosen or treated for enhanced resistance to penetration by liquid water.

The disclosures herein are now further illustrated with reference to the exemplary illustrations of FIGS. 5, 7, and 9-16, which depict stiffening element 200 in various embodiments and configurations. Stiffening element 200 can be chosen from any suitable material, of any suitable design, that will function according to the procedures disclosed herein. Stiffening element 200 should have a physical size and shape, and stiffness, suitable for providing the desired enhancing of the ability of expanded mask 1 to maintain a cup shape. In a common design in which mask 1 is of a generally elongated shape, it may be useful for stiffening element 200 to have an elongated shape with the long axis of stiffening element 200 generally aligned with the long axis of mask 1 (e.g., as shown in FIGS. 5 and 7).

Stiffening element 200 may be comprised of a solid sheet. Or, it may be comprised of a porous material (for example, a nonwoven material, a woven or knitted fabric, and the like). While it might be useful in certain instances for stiffening element 200 to be porous (e.g., in order to ensure that stiffening element 200 does not unacceptably interfere with the airflow through mask 1), this may not be necessary for example if stiffening element 200 is sufficiently small, and/or if sufficient leakage of air around the perimeter of stiffening element 200 occurs, such that the airflow through mask 1 is satisfactory. In a particular embodiment (and whether or not stiffening element 200 is made of a porous material) stiffening element 200 can comprise one or more perforations (i.e., through-holes) 253, as in the exemplary illustration of FIG. 9, which may aid in providing satisfactory airflow.

In various embodiments, stiffening element 200 may comprise a nonwoven sheet material, e.g., a spunbonded, spunlaced, flashbonded, carded, SMS, thermally-bonded spunlaid, or any other of the well known nonwoven materials, that comprises suitable properties for the purposes disclosed herein. In various specific embodiments, stiffening element 200 may comprise a nonwoven material with a basis weight of from about 20 grams per square meter to about 100 grams per square meter, from about 40 grams per square meter to about 100 grams per square meter, or from about 60 grams per square meter to about 90 grams per square meter. In a specific embodiment, outside cover layer 150 is comprised at least in part of a spunbonded polypropylene.

Suitable nonwoven materials may include for example the material available from Colbond Corp. of Arnhem, Netherlands, under the trade designation Colback Fabric, Type WHD 75, and the material available from Midwest Filtration, Cincinnati, Ohio, under the trade designation Unipro 260 FX, and the like.

Stiffening element 200 comprises at least one engaging feature 205 that is capable of engaging with porous layer 100. In a specific embodiment, stiffening element 200 comprises a plurality of engaging features 205. In this embodiment, engaging features 205 may be discrete (e.g., a set of individually discernable barbs, protrusions, etc.). Or, the plurality of engaging features 205 may not comprise discrete (e.g., distinguishable from each other) engaging features, but may nevertheless function as a plurality of engaging features. For example, in the exemplary embodiments of FIGS. 5 and 7, perimeter edge 210 of stiffening element 200 comprises (functions as) a plurality of engaging elements 205.

While in the exemplary embodiments of FIGS. 5 and 7, perimeter edge 210 alone may provide satisfactory engaging features 205, in alternative embodiments further provisions can be taken to provide additional engaging features 205 and/or to enhance the ability of engaging features 205 to engage porous layer 100. For example, this may be done by providing discontinuities in perimeter edge 210. Thus, in the exemplary embodiment of FIG. 9, stiffening element 200 comprises a sheet-like material with slits 251 provided in a spaced arrangement around the perimeter of stiffening element 200. Such slits (which may be, e.g., from about 0.3 mm to about 10 mm long), may provide an increased number of engaging features 205, and/or may provide engaging features 205 with enhanced engagement properties, by virtue of the increased amount of edge surface, and in particular the presence of corners 255, any or all of which may enhance the engaging of stiffening element 200 with porous layer 100.

Figure 10:
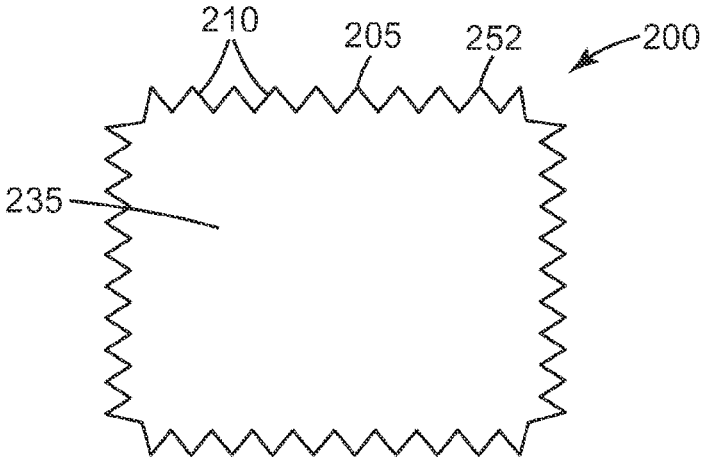
FIG. 10 is a plan view of an exemplary stiffening element.

In the exemplary embodiment illustrated in FIG. 10, perimeter edge 210 of element can be provided with protruding portions (e.g., corners) 252, for example by die cutting in a sawtooth pattern. This may provide an increased number of engaging features 205, and/or may provide discrete engaging features 205 with enhanced engagement properties, compared to that which might be exhibited by a plurality of engaging features 205 provided by a relatively continuous (e.g., smooth and/or uninterrupted) perimeter edge 210 (e.g., as shown in FIG. 5).

Figure 11:
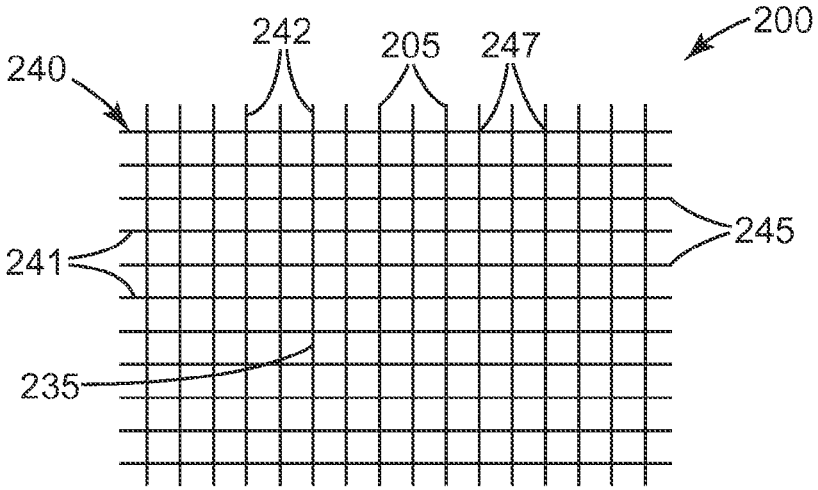
FIG. 11 is a plan view of an exemplary stiffening element.
Figure 12:
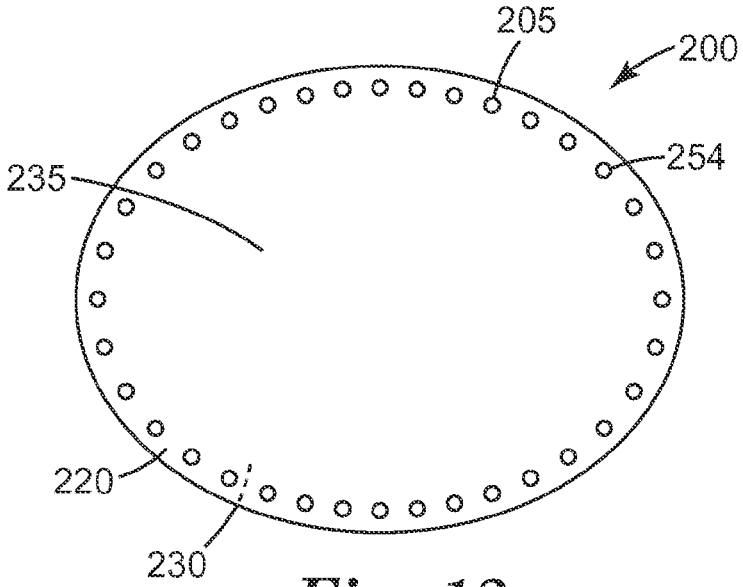
FIG. 12 is a plan view of an exemplary stiffening element.

In still another embodiment, stiffening element 200 may be comprised of an assembly of one or more strands. In the specific exemplary embodiment illustrated in FIG. 11, stiffening element 200 comprises a sheet-like piece of netting (e.g., mesh) comprised at least in part of strands 240 that connect at intersections 247. In FIG. 11, strands 240 comprise a set of generally parallel strands 241 and another set of generally parallel strands 242 that are oriented generally perpendicular to strands 241; however, many configurations are possible. A stiffening element 200 comprising such netting, in which the perimeter of the netting is defined by terminal ends 245 of certain of strands 240, may be advantageous in that terminal ends 245 (e.g., as achieved in the act of cutting the netting to the desired shape to form stiffening element 200) of the strands may act as engaging features 205 (e.g., barbs) that may have an enhanced ability to engage with porous layer 100. The netting may be chosen from any suitable material, including plastic, wire, wood or cellulose, and the like. In a specific embodiment, the netting comprises intersecting, interconnected strands comprised of an oriented thermoplastic polymeric material. The parameters of the netting (e.g. strand diameter, strand spacing, and the like), can be chosen as desired.

Nettings that may be used as described herein include for example those materials available from Conwed Corp. of Minneapolis, Mn, under the trade designations 5103, RO3470-007, X01678, and X04410.

In certain above-described embodiments, engaging features 205 are provided primarily by edge (e.g., perimeter edge) 210 of stiffening element 200 and/or by features (e.g., slits, protrusions, etc.) that are provided on or in perimeter edge 210, and that face outward from stiffening element 200 generally in the plane of stiffening element 200. In an alternate embodiment, at least some engaging features 205 may be provided on at least some portion of surface 220 (that is, the surface that faces porous layer 100) of stiffening element 200. For example, engaging features 205 can comprise a plurality of protrusions 254 (e.g., posts, stems, barbs, or the like), located on surface 220 of stiffening element 200. In one embodiment, protrusions 254 are located at least near (e.g., within a few mm of) perimeter edge 210 of stiffening element 200. In a specific embodiment (e.g., as shown in the exemplary embodiment of FIG. 12), protrusions 254 are located near perimeter edge 210 of stiffening element 200 and are not located in other portions of stiffening element 200.

The shape and size of protrusions 254, the angle at which they protrude, and/or the spacing therebetween, may be chosen such that protrusions 254 allow sliding movement of an adjacent porous layer 100 past protrusions 254 in a desired first direction, but (individually and/or collectively) prevent such sliding movement in a second, opposite direction. One exemplary design is shown in generic representation in FIG. 13, in which multiplicity of tapered, angled protrusions 254 are present which may allow motion of an adjacent portion of a porous layer 100 in certain directions, but may prevent retrograde motion of the adjacent portion in certain other directions.

Figure 13:
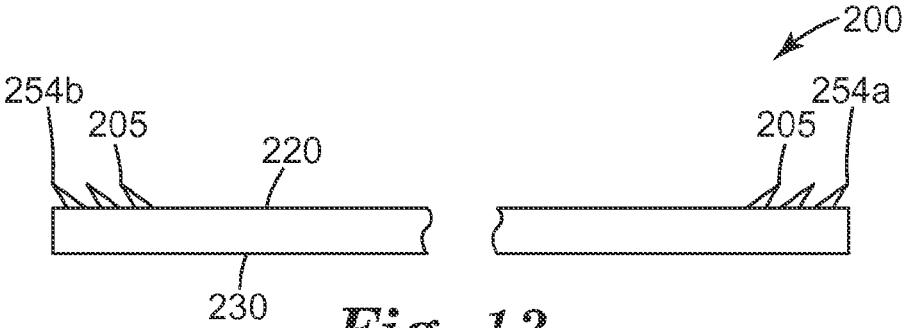
FIG. 13 is a schematic cross sectional view of an exemplary stiffening element.

In the specific embodiment shown in FIG. 13, protrusions 254*a* at one end of stiffening element 200 are generally oppositely oriented from protrusions 254*b* at an opposite end of stiffening element 200, such that the two sets of protrusions 254 prevent sliding movement of their respective adjacent portions of porous layer 100, in generally opposite directions.

In one embodiment, engaging feature(s) 205 may comprise pressure sensitive adhesive, as long as such pressure sensitive adhesive does not unacceptably restrict the desired ability of the engaging feature to permit the slidable movement of an adjacent portion of porous layer 100 in the desired direction. In an alternative embodiment, engaging feature(s) 205 does not comprise pressure sensitive adhesive.

Stiffening element 200 (whether a solid material, a netting, a porous web, etc.) can be made of any desired material (e.g., metal, wood, plastic, ceramic, etc.). In many cases, it may be desirable to use plastic materials, due to their low cost and compatibility with other components of mask 1. In a particular embodiment, stiffening element 200 may be comprised at least partially of a polymeric material of a same or similar composition as a material that is present in porous layer 100, or is compatible with melt-bonding to a material that is present in porous layer 100, such that melt-bonding can be used to bond stiffening element 200 to porous layer 100 if desired.

The materials of construction and the thickness of stiffening element 200 can be chosen as desired to provide the desired stiffness. For example, stiffening element 200 should be at least stiff enough to enhance the ability of mask 1 to maintain its expanded cup-shaped configuration. That is, the engaged combination of stiffening element 200 and porous layer 100 should provide enhanced ability of mask 1 to resist forces that would tend to deform cup-shaped mask 1 toward a more flat configuration (e.g., forces applied generally normal to porous layer 100). It should be noted that the inventor has discovered that, possibly due to the fact that when stiffening element 200 is engaged with porous layer 100, stiffening element 200 and porous layer 100 may provide mutual reinforcement to each other, the combined, engaged layers may provide more ability to resist deforming than the two layers exhibit when not so engaged. Thus, in certain embodiments, it may be possible to use a surprisingly lightweight, flexible, and/or porous material for stiffening element 200. In various embodiments, stiffening element 200 can have a basis weight of at most about 50 grams per square meter, about 35 grams per square meter, or about 22 grams per square meter. In specific embodiments, stiffening element 200 comprises a netting (e.g., such as those available from Conwed, as mentioned above) with a basis weight of at most about 50 grams per square meter, about 35 grams per square meter, or about 22 grams per square meter.

In one embodiment stiffening element 200 is provided in a generally flat, unpleated configuration. However, in various embodiments, stiffening element 200 can be pleated (either alone or in combination with porous layer 100); however, such pleating of stiffening element 200 should not detract from the herein-described ability of stiffening element 200 to allow certain portions of porous layer 100 to slidably move past certain portions of stiffening element 200 and to prevent these portions of porous layer 100 from slidably moving past those portions of stiffening element 200 in a second direction generally opposite to the first direction.

Figure 14:
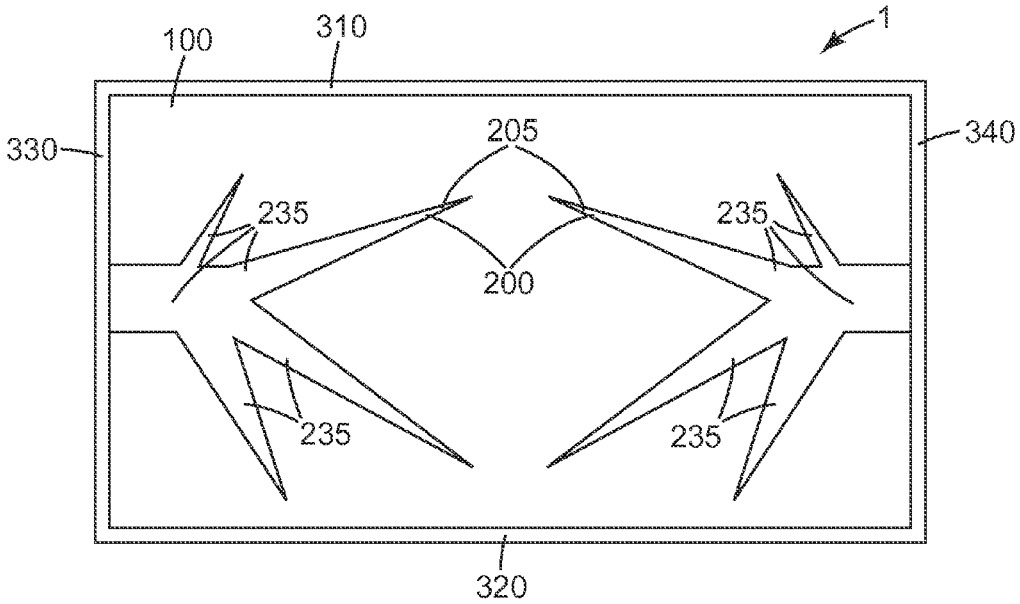
FIG. 14 is a plan view of an exemplary pleated mask comprising two exemplary stiffening elements.

Stiffening element 200 can optionally be bonded to a portion of porous layer 100, as long as such bonding does not unacceptably restrict the expansion of porous layer 100. (such bonding may be performed before or after the pleating of porous layer 100). For example, stiffening element 200 can be attached (e.g., bonded, such as by ultrasonic bonding) to porous layer 100 by a spot-bond, or by a line bond (e.g., positioned near the center of porous layer 100 and oriented generally parallel to the long axis of porous layer 100). Other configurations are possible. For example, in various embodiments, stiffening element 200 can be bonded to porous layer 100 at or near lower edge 320 or upper edge 310, or side edge 330 or 340 (as shown in FIG. 14), rather than being bonded at or near the center of porous layer 100. In the specific embodiment in which an end of stiffening element 200 is attached to porous layer 100 (e.g., at or near an edge of porous layer 100), engaging feature(s) 205 may be provided at or near an end of stiffening element 200 that is generally opposite the attached end, and may be oriented so as to permit slidable movement of an adjacent portion of porous layer 100 in a direction away from the attached end, and to prevent slidable movement of the adjacent portion of porous layer 100 in a direction toward the attached end.

In one embodiment, stiffening element 200 can be removably attached to mask 1 (e.g., to porous layer 100 of mask 1). That is, rather than using e.g. an ultrasonic bond, stiffening element 200 may comprise a removable attachment mechanism so as to be removably attachable to porous layer 100. Such removable attachment might take advantage of the fibrous nature of porous layer 100, for example by providing stiffening element 200 with a hook patch (e.g., near the center of stiffening element 200) by which stiffening element 200 can be removably attached to porous layer 100 by the well-known methods used by so-called hook-and-loop fasteners. (In such a design, the removable attachment mechanism should of course not interfere with the ability to expand porous layer 100 to the desired extent).

In one embodiment, stiffening element 200 is not attached to any components or layers of mask 1 (other than the above-mentioned optional attachment to porous layer 100) or attached or connected to any other external item or structure.

In one embodiment, one or more secondary layers of porous material (not shown in any figure, and which may comprise a filtration layer and/or or a cover web layer) may be present on the other side of stiffening element 200 from porous layer 100 (e.g., facing the user's face when worn). Such a sandwiched configuration may serve to help hold stiffening element 200 in place and/or to negate the need to bond stiffening element 200 to porous layer 100.

Most of the above-discussed embodiments have shown stiffening element 200 as a single piece (e.g., generally rectangular or oblong in shape). However, rather than being provided as a single piece, multiple stiffening elements 200 can be provided. For example, in the exemplary embodiment shown in FIG. 14, two stiffening elements 200 are provided.

Rather than being of a generally oblong or rectangular perimeter, stiffening element 200 can comprise one or more "fingerlike" portions (e.g., as shown in generic representation in FIG. 14, with pleats and certain other features of mask 1 not shown). Such an arrangement may provide suitable enhancing of the ability of porous layer 100 to maintain a cup-shaped configuration, while using the minimum amount of material to form stiffening element 200. It is noted that, in such embodiments, engaging features 205 at various locations of stiffening element 200 might not necessarily be located at "opposite ends" of stiffening element 200 (as they might be if stiffening element 200 is a shape such as rectangular, circular, etc.). However, in an embodiment of the type pictured in FIG. 14, engaging features 205 may be arranged such that certain engaging features 205 (e.g., at the terminus of certain "fingers" of stiffening element 200) prevent slidable movement of a portion of porous layer 100 adjacent to those engaging features, in a direction that is substantially opposite a direction in which certain other engaging features 205 (e.g., at the terminus of certain other "fingers" of stiffening element 200) prevent motion of a portion of porous layer 100 that is adjacent thereto. And, it is also possible to configure stiffening element(s) 200 such that various engaging features 205 do not necessarily prevent slidably movement of portions of porous layer 100 that are adjacent thereto, in directions that are opposite to directions of slidable movement of portions of porous layer 100 prevented by other engaging features 205. In such cases, engaging features 205 may collectively supply the desired functionality disclosed herein, even if no specific two engaging features 205 happen to prevent slidable movement of a portion of porous layer 100 adjacent thereto, in exactly opposite directions.

Figure 15A:
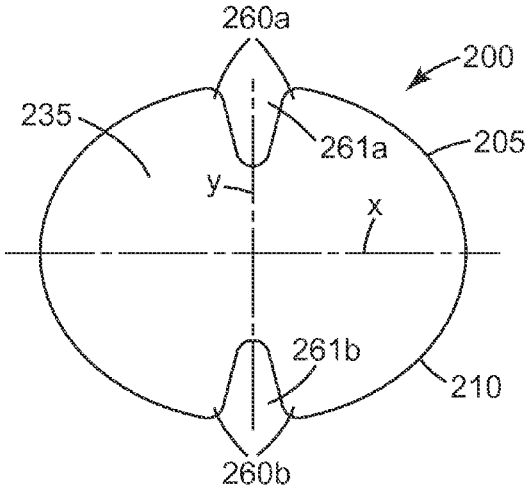
FIG. 15*a* is a plan view of an exemplary stiffening element.
Figure 15B:
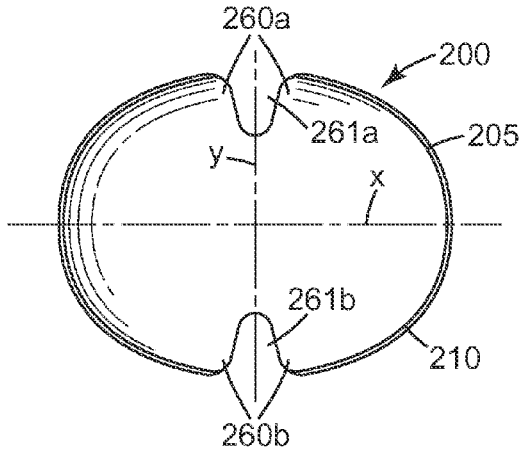
FIG. 15*b* is a plan view of the exemplary stiffening element of FIG. 15*a*, in an arcuate configuration.
Figure 16A:
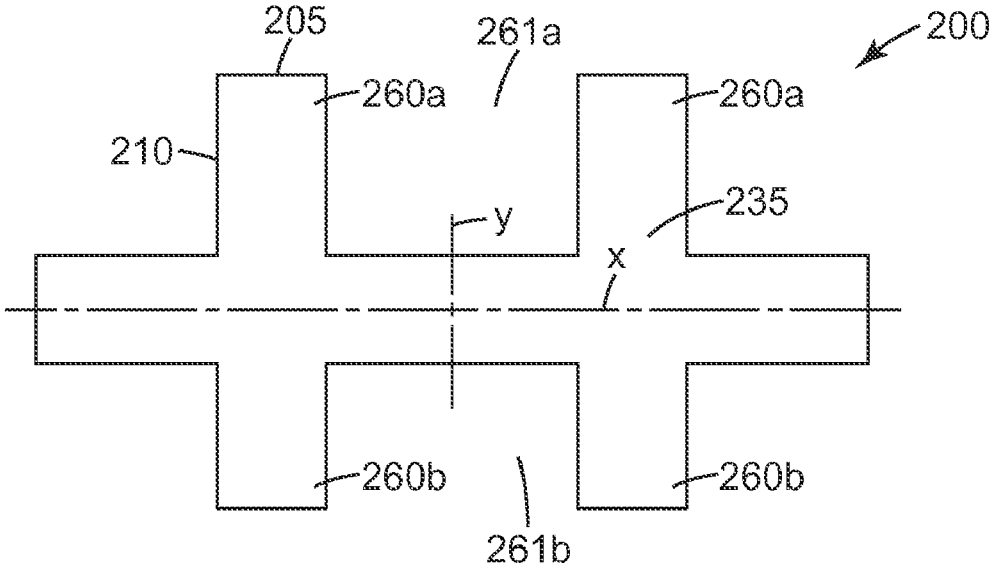
FIG. 16*a* is a plan view of an exemplary stiffening element.
Figure 16B:
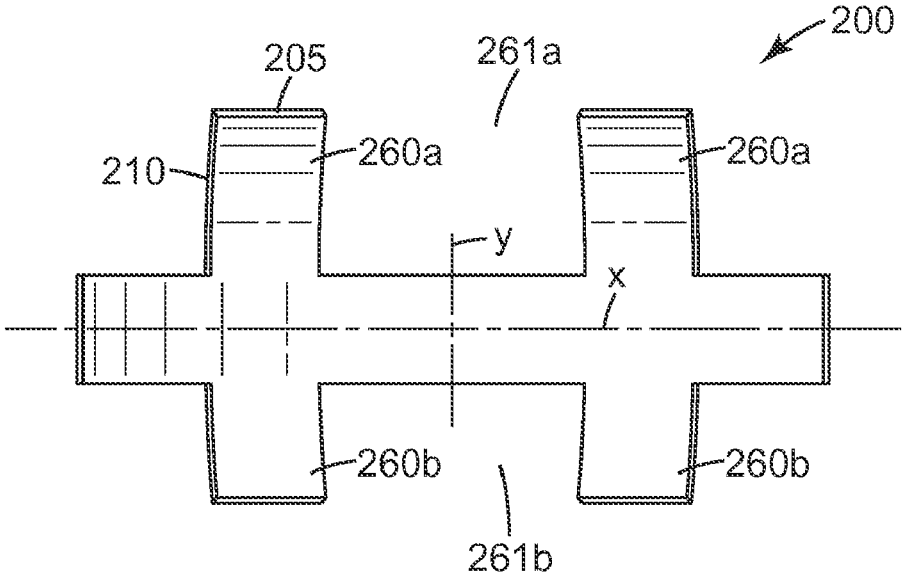
FIG. 16*b* is a plan view of the exemplary stiffening element of FIG. 16*a*, in an arcuate configuration.

In various embodiments, stiffening element 200 may be provided in a shape that promotes and/or controls the bending (bowing) of stiffening element 200 into an arcuate shape when mask 1 is in an expanded, cup-shaped configuration. FIGS. 15 and 16 illustrate two such representative embodiments. In such designs, stiffening element 200 may comprise one or more notches 261 such that stiffening element 200 comprises lobed projections 260. Such a lobed design may promote the bending of portions, or the entirety, of stiffening element 200 generally along one or more axes parallel to axis "x", and/or generally along one or more axes parallel to axis "y". Thus, stiffening element 200 may assume an at least slightly bowed, arcuate shape (e.g., as shown in FIGS. 15*b* and 16*b*) when mask 1 (not shown in these Figs.) is in an expanded, cup-shaped configuration.

Notches 261 may be e.g. relatively small such that stiffening element 200 comprises a generally oblong configuration, as in the exemplary illustration of FIG. 15. Alternatively, notches 261 may be e.g. relatively large (e.g., deep and/or wide) such that stiffening element 200 comprises a central portion with various projecting lobes 260 extending therefrom, as in the exemplary illustration of FIG. 16. Stiffening element 200 may comprise a somewhat rounded perimeter (e.g., as in FIG. 15), a perimeter comprising relatively straight edges and sharp corners (e.g., as in FIG. 16), or some combination thereof. While typically possessing horizontal symmetry (i.e., with respect to reflection along the "y" axis of FIGS. 15 and 16) stiffening element 200 may comprise symmetric, or asymmetric, vertical symmetry (i.e., with respect to reflection along the "x" axis of FIGS. 15 and 16). For example, in the exemplary illustration of FIG. 16, upper notch 261*a* is greater in vertical extent, and upper projecting lobes 260*a* are longer, in comparison to lower notch 261*b* and lower projections 260*b*. Such choices can be made based upon the particular mask 1 and features thereof (e.g., number and spacing of pleats, etc.), and in consideration of the face-fitted comfort imparted to the user thereby.

In one embodiment, in the production of mask 1*a* continuous strip of stiffening element 200 can be positioned adjacent porous layer 100 (e.g., generally aligned with the long axis of porous layer 100) and bonded to porous layer 100 at least at edges 310, 320, 330 and/or 340 (with any excess stiffening element material being removed, e.g., by die cutting). Such a configuration may allow for ease of manufacturing mask 1. In such a configuration, the continuous strip may have features (e.g., slits, cut-out sections, etc.) for enhanced performance.

Stiffening element 200 (of any exemplary embodiment described above) can be configured and/or treated as desired for the comfort of the user. For example, (wearer-facing) surface 230 of stiffening element 200 can be partially or completely covered with fibrous material or the like, if it is desired to provide a surface which may be perceived as softer to the touch. It is possible to provide mask 1 with a second porous layer such that stiffening element 200 is partially or complete sandwiched between the second porous layer and porous layer 100, such that any skin contact with the inner portion of mask 1 will be with the second porous layer. While in most cases stiffening element 200 may not provide any filtration capability (with all such capability being supplied e.g., by filtration layer 140 of porous layer 100), it would be possible to impart stiffening element 200 with some filtration capability, sorption capacity, etc., if desired.

Although the discussions herein have primarily used the term "mask", it is understood that this term is used broadly to encompass devices that may be designated by terms such as respirator, personal respiratory protection device, surgical mask, operating room mask, clean room mask, dust mask, breath warming mask, face shield, and the like, in applications including e.g., industrial operations, consumer, home and outdoor use, health care operations, and the like. Such uses may include those in which the mask may be intended primarily for protection of a user's respiratory system, those in which the mask may be intended primarily to prevent material expelled from the user's respiratory system from reaching and/or contaminating the external environment, and uses that encompass both purposes. Masks as disclosed herein 1 can comprise other features and functionalities as desired. These might include, for example, one or more exhalation valves, nose clips, face seals, eye shields, neck coverings, and the like.

The present invention has now been described with reference to several embodiments thereof. It will be apparent to those skilled in the art that changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A flat-folded, pleated face mask that is expandable into a cup shape for fitting over the mouth and nose of a person, comprising:

at least one porous layer that comprises at least one pleat and that is capable of being expanded by at least partially unfolding the at least one pleat;

and, at least one stiffening element adjacent at least a portion of the porous layer and with at least portions of the stiffening element being in overlapping relation with at least portions of the at least one pleat, the stiffening element comprising at least one engaging feature in a first location on the stiffening element, wherein the at least one engaging feature is arranged to allow a portion of the porous layer that is adjacent the engaging feature to slidably move past the engaging feature in a first direction during expansion of the at least one porous layer into a cup shape; and, wherein the at least one engaging feature is further arranged to prevent a portion of the expanded porous layer that is adjacent the engaging feature from slidably moving past the engaging feature in a second direction opposite the first direction, while the porous layer is in the cup shape.

2. The face mask of claim 1, wherein the stiffening element is attached to the porous layer in a second location on the stiffening element that is different from the first location comprising the engaging feature.

3. The face mask of claim 2 wherein the second location on the stiffening element, at which the stiffening element is attached to the porous layer, is at an end of the stiffening element.

4. The face mask of claim 2, wherein the stiffening element is attached to the porous layer at or near an edge of the porous layer, and; wherein the first location on the stiffening element, comprising the at least one engaging feature, is at an opposite end of the stiffening element from the second location on the stiffening element, and wherein the at least one engaging feature is arranged so as to allow the adjacent portion of the porous layer to slidably move in a first direction that is away from the second location on the stiffening element, and is further arranged to prevent the adjacent portion of the porous layer from slidably moving in a second direction that is toward the second location.

5. The face mask of claim 1 wherein the porous layer comprises at least two generally parallel, oppositely oriented pleats and is capable of being expanded by at least partially unfolding the at least two pleats, and where at least portions of the stiffening element are in overlapping relation with at least portions of the at least two pleats.

6. The face mask of claim 1 wherein the stiffening element comprises a plurality of engaging features on at least a portion of a perimeter of the stiffening element.

7. The face mask of claim 6 wherein the engaging features are disengageable from the porous layer.

8. The face mask of claim 6 wherein the engaging features comprise perimeter edges of the stiffening element.

9. The face mask of claim 6 wherein the stiffening element comprises a netting comprising at least a plurality of strands, and wherein the engaging features comprise the terminal ends of at least some of the strands.

10. The face mask of claim 1 wherein the stiffening element comprises at least a first major surface that faces a first major surface of the porous layer, and wherein the at least one engaging feature comprise a plurality of protrusions that protrude from the first major surface of the stiffening element.

11. The face mask of claim 1 wherein the stiffening element is air-permeable.

12. The face mask of claim 1 wherein when the face mask is in an unexpanded condition the porous layer of the pleated face mask comprises a generally flat-folded, planar configuration and the sheetlike stiffening element is oriented substantially parallel to the plane of the flat-folded porous layer and is in contact with at least a portion of the first major surface of the porous layer.

13. The face mask of claim 1 wherein the porous layer comprises a generally elongated shape with a long axis and comprises multiple pleats generally oriented parallel to the long axis of the porous layer.

14. The face mask of claim 13, wherein the flat-folded, pleated face mask, and the at least one porous layer, comprise a long axis and a short axis, and wherein engaging features are provided around at least a portion of the perimeter of the stiffening element so as to prevent sliding movement of adjacent portions of the expanded cup-shaped porous layer generally inward toward an interior area of the stiffening element, along at least the long axis and the short axis of the pleated face mask.

15. The face mask of claim 1 wherein the porous layer comprises at least one unfoldable pleat that is not adjacent to the stiffening element.

16. The face mask of claim 1 wherein the stiffening element comprises at least one fold or pleat.

17. The face mask of claim 1 wherein the face mask is a folded mask comprising a fold line arranged such that an upper edge of the mask is adjacent a lower edge of the mask when the mask is in an unexpanded condition.

18. The face mask of claim 17 wherein the fold line is a bisecting fold line.

19. The face mask of claim 17 wherein the stiffening element is comprises at least one fold arranged so that the stiffening element is folded along with the folded mask.

20. The face mask of claim 17 wherein the face mask comprises side edges that are bonded seamed edges.

* * * * *

UNITED STATES PATENT AND TRADEMARK OFFICE

CERTIFICATE OF CORRECTION

PATENT NO. : 8,360,067 B2
APPLICATION NO. : 13/291528
DATED : January 29, 2013
INVENTOR(S) : Dean Roy Duffy It is certified that error appears in the above-identified patent and that said Letters Patent is hereby corrected as shown below:

In the Specifications:

Column 7
Line 67, Delete "BODY," and insert -- BODY (attorney case no. 65001US002), --, therefor.

In the Claims:

Column 18
Line 53, In Claim 19, before "comprises" delete "is".

Signed and Sealed this
Fourteenth Day of May, 2013

Teresa Stanek Rea
*Acting Director of the United States Patent and Trademark Office*